US006048223A

United States Patent [19]

Bechaz et al.

[11] Patent Number: 6,048,223

[45] Date of Patent: Apr. 11, 2000

[54] TERMINAL BLOCK COMPRISING TWO CONNECTION DEVICES

[75] Inventors: Bernard Bechaz, Caluire; Luc Doutaz, Bron; Ariel Ruz, Villeurbanne, all of France

[73] Assignee: Entrelec S.A., Villeurbanne, France

[21] Appl. No.: 09/345,192

[22] Filed: Jun. 30, 1999

[30] Foreign Application Priority Data

Jun. 30, 1998 [FR] France ..... 98 08478

[51] Int. Cl.[7] ..... H01R 4/24

[52] U.S. Cl. ..... 439/417; 439/409

[58] Field of Search ..... 439/417, 391, 439/817

[56] References Cited

U.S. PATENT DOCUMENTS 4,466,682 8/1984 Jusseau et al. ..... 439/407
4,561,712 12/1985 Borne et al. ..... 439/397
4,776,812 10/1988 Boissonnet et al. ..... 439/407

FOREIGN PATENT DOCUMENTS 0087158 11/1986 European Pat. Off. .
0247360 10/1991 European Pat. Off. .

*Primary Examiner*—M. L. Gillner
*Assistant Examiner*—Briggitte Hammond
*Attorney, Agent, or Firm*—Ware, Fressola, Van Der Sluys & Adolphson LLP

[57] ABSTRACT

Terminal block comprising two connection devices In this terminal block, each connection device has a stripping and retaining slot provided with a wire entry at one end, as well as an insulating casing having, opposite the slots, an opening allowing a wire facing the wire entry to be inserted and slid into the slot. The stripping slots are approximately parallel and the wire entries face each other. The terminal block also has, placed between the two connection devices, a double pusher fitted so as to slide parallel to the direction of the stripping slots between a position of interpenetration with respect to a first connection device and a position of interpenetration with respect to the other connection device.

16 Claims, 2 Drawing Sheets

FIG4
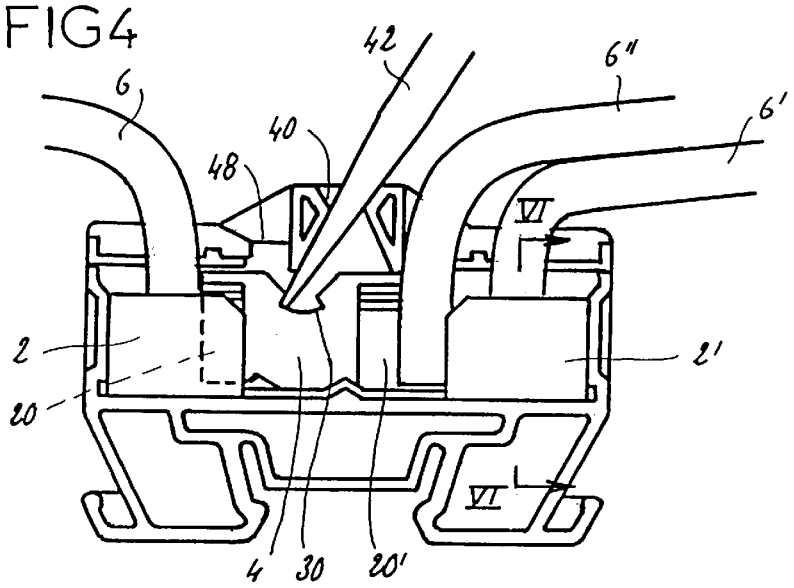
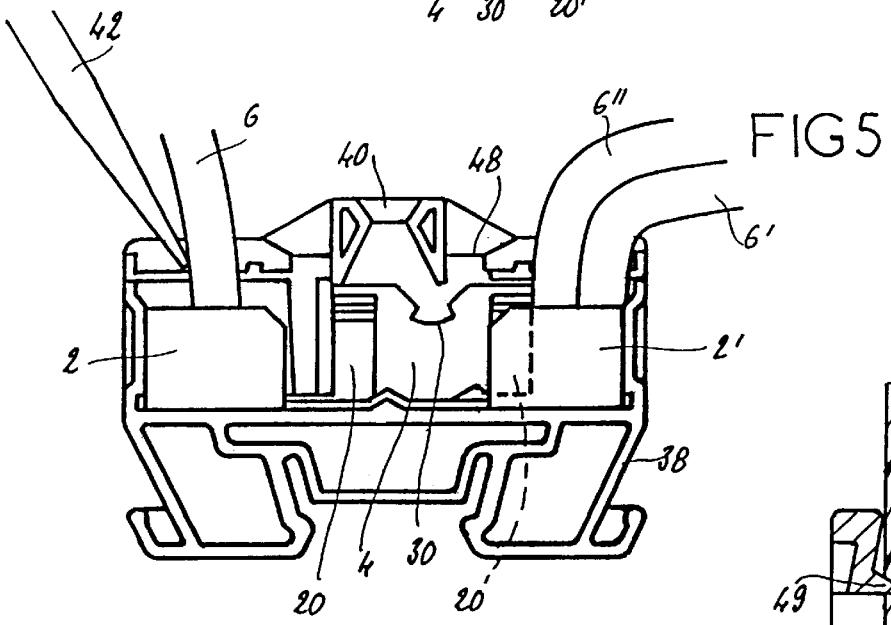
FIG5
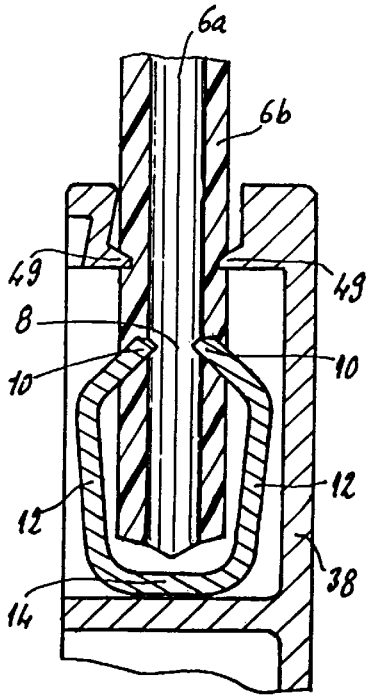
FIG6

TERMINAL BLOCK COMPRISING TWO CONNECTION DEVICES

TECHNICAL FIELD

The present invention relates to a terminal block comprising two connection devices.

DESCRIPTION OF THE PRIOR ART

Such a terminal block is, for example, used in an electrical cabinet for connecting two ends of electrical wires. The two connection devices are then electrically connected together. Such double connection devices are already known. Patent EP-0,087,158 shows, for example, a device having two insulation-displacement connection arrangements.

Known devices of this type are relatively bulky.

SUMMARY OF THE INVENTION

The object of the present invention is therefore to provide a connection terminal fitted with two connection devices for connecting two (or more) electrical wires, the overall size of which is small.

Preferably, it will be possible to produce the terminal block according to the invention easily and have a relatively low manufacturing cost.

For this purpose, the terminal block proposed by the invention is a terminal block comprising two connection devices, each connection device having a stripping and retaining slot provided with a wire entry at one end, as well as an insulating casing into which the connection devices are fitted, which casing has, opposite the stripping and retaining slots, an opening allowing a wire facing the wire entry of the slot to be inserted and slid into the slot.

According to the invention, the stripping slots are approximately parallel, the wire entries facing each other or being offset transversely with respect to the direction of the slots. The terminal block also has, placed between the two connection devices, a double pusher fitted so as to slide parallel to the direction of the stripping slots between a position of interpenetration with respect to a first connection device and a position of interpenetration with respect to the other connection device.

A single pusher is sufficient here to allow connection to the two connection devices. The saving in space compared with known solutions, which all use as many pushers as there are connection devices, is considerable.

In a preferred embodiment, the pusher of the terminal block according to the invention is shaped in such a way that when it lies in a position of interpenetration with respect to a connection device it lies in a position making it possible to insert a wire via the opening provided for this purpose in the casing and to position this wire at the wire entry of the stripping and retaining slot. The travel of the pusher then corresponds to the travel necessary for inserting a wire into a connection device.

In a simple embodiment of the terminal block according to the invention, the pusher is a piece which is symmetrical with respect to a midplane perpendicular to the stripping and retaining slots.

It is also possible to have aligned stripping and retaining slots and the pusher is then advantageously a piece which is symmetrical with respect to a midplane containing the stripping and retaining slots.

The two connection devices are, for example, connected by a linking strip on which the pusher slides. The pusher is then guided by the linking strip and optionally the insulating casing of the terminal block.

In this latter embodiment, the terminal block according to the invention is advantageously such that the linking strip has a projection and such that the pusher has two notches on its face in contact with the strip, the projection and the notches being arranged in such a way that the projection lies in a notch when the pusher lies in a position of interpenetration with respect to a connection device. The interpenetration positions of the pusher with respect to the connection devices are therefore indexed.

Advantageously, the pusher is actuated using the blade of a screwdriver inserted into the casing from the outside of the terminal block. In this case, the insulating casing has, for example, an opening which converges and then diverges toward the inside of the casing and, oppposite this opening, the pusher has a recess intended to take the end of a screwdriver blade. The pusher is moved translationally by pivoting the screwdriver blade in the region of smallest cross section of the opening in the casing.

The terminal block according to the invention advantageously uses connection devices such as those disclosed by document EP-0,247,360. In this case, each connection device has a conducting piece with a cross section corresponding to a U, the free ends of which have been folded obliquely and equally toward each other so as to leave between them a space corresponding to the width of the stripping and retaining slot.

When a connection block with such connection devices is used, the pusher advantageously has at each of its ends a substantially T-shaped profile, which is narrowed at the junction between the two arms of the T, so as to be able to slide in the conducting piece on both sides and between the edges of the stripping and retaining slot by being guided inside the conducting piece. Thus there is very good guiding of the pusher during stripping and connection and also proper pushing of the connected wire since the latter is pushed on both sides of the stripping and retaining slot.

BRIEF DESCRIPTION OF THE DRAWING

In any case, the invention will be clearly understood with the aid of the description which follows, with reference to the appended diagrammatic drawing which represents, by way of nonlimiting example, a preferred embodiment of the invention.

FIGS. 2 to 5 show a longitudinal sectional view of a connection block according to the invention in various connection positions.

FIG. 6 is a partial sectional view on a larger scale on the line of section VI—VI in FIG. 4.

DESCRIPTION OF THE PREFERRED EMBODIMENT

Figure 1:
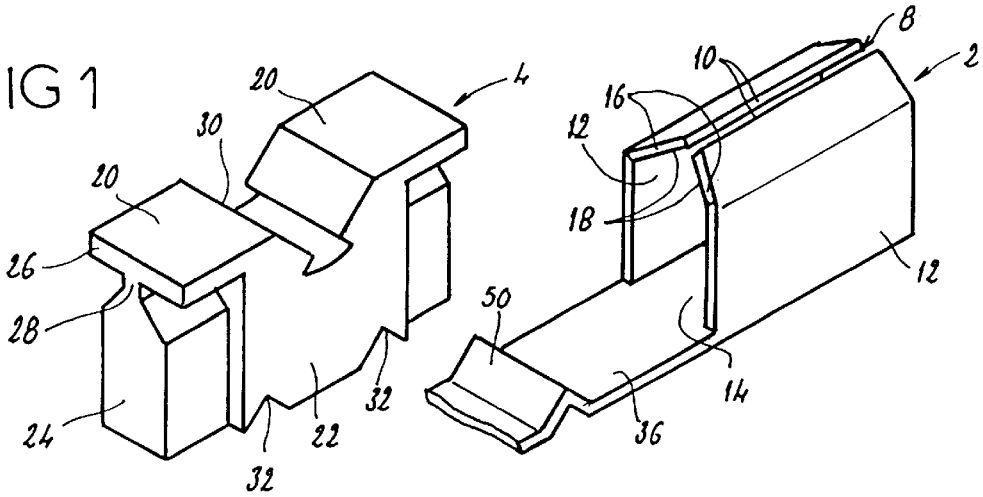
FIG. 1 shows an exploded perspective view of a connection device and a corresponding pusher.

FIG. 1 shows an insulation-displacement connection jaw 2 and a pusher 4 allowing a wire 6 to be inserted into the jaw.

The jaw 2 is made of a conducting material. It corresponds, for example, to the jaw described in Patent EP-0,247,360.

The jaw 2 has a slot 8 for stripping and retaining a wire 6. The slot 8 here is straight and arranged longitudinally along a profile-shaped part of the jaw 2, which is obtained here, for example from a flat blank, by stamping, which entails cutting and folding it and possibly thinning it in places.

The profiled part of the jaw 2 has a hollow polygonal cross section which corresponds to a U, the free ends of which have been obliquely and equally folded toward each other.

The profiled part thus obtained has two flaps 10 with ends corresponding to the abovementioned obliquely and equally folded free ends. These two flaps 10 border the slot 8, which they define, and, optionally, they become gradually thinner toward this slot 8.

The profiled part of the jaw 2 has two parallel walls 12 which form the two arms of the U. Each of these walls carries a flap 10 and ensures that the jaw 2 cannot move when it is installed in a housing made in a terminal block, together with a bottom wall 14 forming the base of the U. The parallel walls 12 are perpendicular to the bottom wall 14.

One end of the slot 8 has a stripping mouth 16. Here, the profiled part has only one stripping mouth but, of course, it is conceivable for it to have a stripping mouth at each end, in order to form a connection arrangement with two entries.

The stripping mouth 16 provided here is obtained by obliquely and symmetrically cutting the flaps 10 at their ends. This oblique cutting makes it possible to obtain a flared mouth. The subsequent folding of the flaps 10 with respect to the walls 12 which respectively carry them creates an edge 18 sufficient to penetrate the sheath of a wire 6 pushed into this mouth.

The pusher 4 is, for example, a piece made of a synthetic material and obtained by molding. It is in the form of an elongate body having two profiled ends 20 connected to a central region 22.

The profiled ends have a generally T-shaped cross section. The part 24 corresponding to the vertical bar of the T is intended to slide inside the hollow profile of a jaw 2. The part 26 corresponding to the transverse bar of the T extends perpendicular to the part 24. The two parts 24 and 26 are connected by a narrowed region 28.

The shape of the ends 20 of the pusher 4 is such that each of its ends 20 can slide in a jaw 2. The part 24 forming the vertical bar of the T then slides inside the profiled part of the jaw 2 whereas the transverse bar corresponding to the part 26 of the end 20 slides outside the profiled jaw 2, while the narrowed region moves in the slot 8.

The central region 22 connects the two ends 20 of the pusher 4. These two ends 20 are aligned profiled regions. On its upper part, i.e. on the same side as the part 26 of the ends corresponding to the transverse bars of the T-shaped profile, the central region has a transverse recess 30 intended to take the end of a screwdriver blade. On its lower face, the central region has two transverse notches 32, each located near a profiled end 20 of the pusher. The role of these notches, of approximately triangular cross section, will be described below with reference to FIGS. 2 to 5.

FIGS. 2 to 5 show, in cross section, a terminal block 34 intended for connecting one or more electrical wires 6. This terminal block 34 is provided with two jaws 2 defining a slot, which are electrically connected via a linking strip 36. The latter is more or less flat and connects the jaws 2, extending the bottom wall 14 of each of these jaws 2.

The jaws 2 are conventionally prevented from moving in housings provided for this purpose in an insulating casing 38 of the terminal block 34, which is, for example, formed by joining together two complementary half-shells which are bonded together by ultrasonic welding after insertion of the internal members that it must contain.

The half-shells are joined together, for example, with the longitudinal midplane of the casing 38 as the mating plane, the line of which can also be seen in the views in FIGS. 2 to 5.

The casing 38 and the various fittings placed inside it exhibit for the most part a symmetry with respect to the mating plane or a plane parallel to it, but also with respect to a plane perpendicular to this mating plane. In FIGS. 2 to 5, elements on the left of these figures are therefore similar to the elements on the right in these figures. For the sake of clarity of the description, the same reference numbers will be used to denote elements on the left and on the right in a figure, but the reference numbers on the right in these figures will have an apostrophe.

The insulating casing 38 has, in its upper part, a centrally placed opening 40. This opening is intended to allow a screwdriver blade 42 to be passed into it and to be guided therein. For this purpose, the opening 40 has, on going from the outside of the casing 38 to the inside of the latter, a converging region 44 followed by a diverging region 46. Thus, the screwdriver blade 42 can pivot about the region of smaller cross section between two extreme positions shown in FIGS. 2 and 3. The converging region 44 and the diverging region 46 therefore define the angle of rotation of the screwdriver blade 42. The opening 40 is intended to allow the screwdriver blade 42 access to the recess 30 in the pusher 4.

The lower part of the insulating casing 38 is shaped so as to allow the casing to be mounted on a mounting rail. This lower part of the casing 38 is not described in detail here as it can have various and varied shapes in order to match the shape of the various mounting rails.

In the insulating casing 38, the two jaws 2 and 2' face each other and the stripping mouths 16 and 16' face each other. The slots of the two jaws 2 and 2' are aligned. The pusher 4 is fitted so as to slide between the two jaws 2 and 2' and its lower face slides on the linking strip 36.

Figure 2:
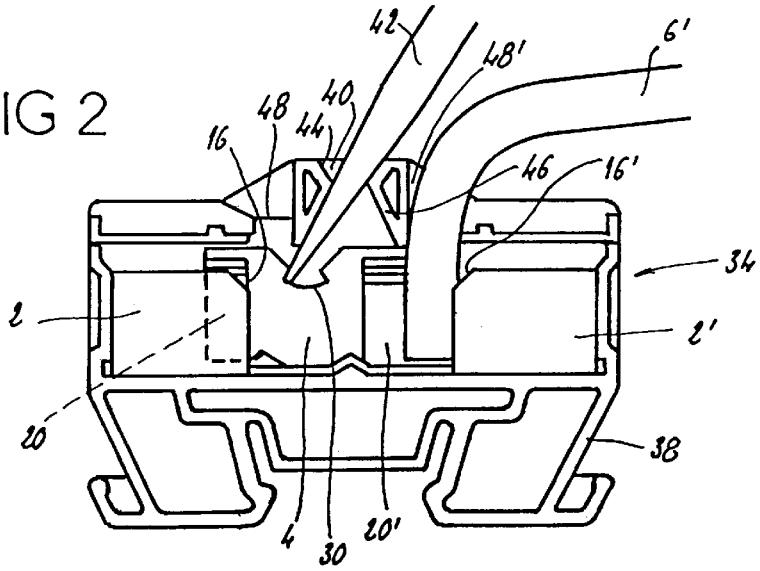

In FIG. 2, the pusher 4 lies in a position of interpenetration with respect to the jaw 2. The part 24 of the end 20 of the pusher 4 lies inside the profiled body of the jaw 2. Between the end 20' of the pusher 4 and the jaw 2' there is a free space sufficient to receive the end of an electrical wire 61. This wire 6' is inserted into the insulating casing via an opening 48' lying alongside the opening 40 allowing the screwdriver blade 42 to be inserted. An opening 48 is produced in the insulating casing symmetrically with the opening 48' with respect to the opening 40.

As seen from above (not show in the drawing) the openings 48 and 48' each have, in a known manner, a shape in the form of a "keyhole" that is to say it has, at one end, a circular shape extended toward the other end by a straight slot whose width is less than the diameter of the circular part. The circular opening lies opposite the wire entry or stripping mouth 16 or 16', while the straight slot faces the stripping and retaining slot of the corresponding jaw 2 or 2'. The edges of the straight slot are bordered by two lips 49 (FIG. 6) which are intended for retaining the sheath **6*b* of a connected wire. FIG. 6 shows that the stripping and retaining slot 8 makes electrical contact with the core 6*a* of the wire and retains the sheath 6*b* and shows how the lips 49 help to improve the retention of the wire by cutting slightly into the sheath 6*b* without, however, baring the core 6*a***.

Figure 3:
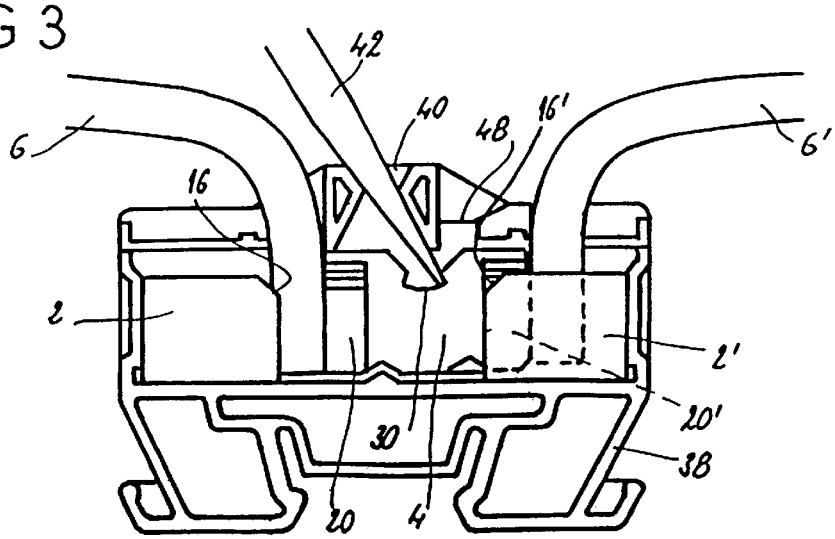

When the end of the wire 6' is inserted into the insulating casing, the screwdriver blade 42 is pivoted in the opening 40 as far as the position shown in FIG. 3. During this movement, the screwdriver blade 42 moves the pusher 4 translationally, because of the recess 30 made in the latter. The pusher 4 then pushes the end of the wire 6' into the jaw 2'. This end of the wire 6' is then stripped and electrical contact made between the core of this wire 6' and the edges of the slot of this jaw 2'. The pusher 4 lies in a position of interpenetration with the jaw 2'. The part 24' of the end 20' of this pusher is in the hollow part of the profiled jaw 2'. During insertion of the end of the wire 6' into the jaw 2', the wire 6' is properly guided by the pusher 4 since the latter exerts its pushing action on both sides of the slot in the jaw 2'.

When the pusher 4 is in the position of interpenetration with the jaw 2' (FIG. 3), there is just sufficient space to house the end of a wire 6 between the jaw 2 and the end 20 of the pusher 4. It may be seen that, when the pusher is in a position of interpenetration with one of the jaws 2 or 2', it is in a position allowing a wire end to be inserted opposite the other jaw 2' or 2. These two positions of the pusher 4 are indexed by means of the notches 32. A projection 50 is produced on the linking strip 36 transversely to the latter. The shape of the projection 50 corresponds to the shape of the notches 32. The size of the notches 32 and of the projection 50 is exaggerated in the figures so as to allow these notches and this projection to be seen more clearly.

When the pusher 4 is in the position of interpenetration with the jaw 2', it is possible to insert the end of a wire 6 via the opening 48 into the casing 38 between the jaw 2 and the end 20 of the pusher 4. In order to connect the wire 6, all that is required is to pivot the screwdriver blade 42 which has been inserted into the opening 40 in order to move the pusher 4 translationally. The end 20 of the pusher therefore acts on the end of the wire 6 in order to insert the latter into the jaw 2. The end of the wire 6 is stripped at the stripping mouth of the jaw 2 and the electrical contact between the core of the wire and the jaw 2 is made at the slot in this jaw via the edges of the slot. When the pusher 4 moves toward the jaws 2, it does not entrain with it the end of the wire 6' inserted into the jaw 2', since the latter is retained by the stripping slot and at the opening 48'. The situation is then the one shown in FIG. 4.

This FIG. 4 shows a wire 6" inserted between the end 20' of the pusher 4 and the jaw 2'. If the slot in the jaw 2' is long enough, this jaw 2' can ensure that two wires 6' and 6" are connected without a problem. With respect to the position shown in FIG. 4, all that is then required is to pivot the screwdriver blade 42 so as to bring the pusher 4 into the position of interpenetration with the jaw 2'. When the end of the wire 6" is pushed by the pusher 4 between the edges of the slot in the jaw 2', this end of the wire 6" in turn pushes the end of the wire 6' which is already in the jaw 2'. The configuration is then the one shown in FIG. 5.

The terminal block according to the invention also allows a wire to be disconnected. The screwdriver blade 42 is then used for pushing, from the outside, the wire that it is desired to disconnect. In the example in FIG. 5, this is the wire 6. The end of the wire 6 to be disconnected is pushed until it lies outside the slot in the jaw 2 or 2'. It can then simply be removed from the casing 38.

It goes without saying that the invention is not limited to the preferred embodiment described above by way of non-limiting example; on the contrary, it encompasses all alternative embodiments lying within the scope of the claims set forth below.

Thus, for example, the shape of the jaws and of the pusher could be completely different. The stripping slot is, for example, not necessarily made in the form of a profile but may be made in the form of a fork, also called a tine. The shape of the pusher is then matched to the shape of the connection device. This pusher does not necessarily push the end of a wire on both sides of the edges defining the stripping and retaining slot and at this slot.

The travel of the pusher in the illustrative embodiment described above was shortened. This makes it possible to go from one extreme position of the pusher to the other extreme position of the pusher via a relatively limited rotation of the screwdriver blade. A rotation of between 60 and 70° turns out to be practical. The travel of this pusher may be extended. It is thus possible to have an intermediate position in which the pusher would lie in a position allowing a wire to enter opposite the two insulation-displacement jaws.

What is claimed is:

1. A terminal block comprising two connection devices, each connection device having a stripping and retaining slot provided with a wire entry at one end, as well as an insulating casing into which the connection devices are fitted, which casing has, opposite the stripping and retaining slots, an opening allowing a wire facing the wire entry of the slot to be inserted and slid into the slot, wherein the stripping slots are approximately parallel, the wire entries facing each other or being offset transversely with respect to the direction of the slots and wherein the casing also has, placed between the two connection devices, a double pusher fitted so as to slide parallel to the direction of the stripping slots between a position of interpenetration with respect to a first connection device and a position of interpenetration with respect to the other connection device.

2. The terminal block as claimed in claim 1, wherein the insulating casing has an opening which converges and then diverges toward the inside of the casing and in that, opposite this opening, the pusher has a recess intended to take the end of a screwdriver blade.

3. The terminal block as claimed in claim 1, wherein the pusher is shaped in such a way that when it lies in a position of interpenetration with respect to a connection device it lies in a position making it possible to insert a wire via the opening provided for this purpose in the casing and to position this wire at the wire entry of the stripping and retaining slot.

4. The terminal block as claimed in claim 3, wherein the pusher is a piece which is symmetrical with respect to a midplane perpendicular to the stripping and retaining slots.

5. The terminal block as claimed in claim 4, wherein the stripping and retaining slots are aligned and in that the pusher is a piece which is symmetrical with respect to a midplane containing the stripping and retaining slots.

6. The terminal block as claimed in claim 5, wherein the two connection devices are connected by a linking strip on which the pusher slides.

7. The terminal block as claimed in claim 6, wherein the linking strip has a projection and wherein the pusher has two notches on its face in contact with the strip, the projection and the notches being arranged in such a way that the projection lies in a notch when the pusher lies in a position of interpenetration with respect to a connection device.

8. The terminal block as claimed in claim 7, wherein the insulating casing has an opening which converges and then diverges toward the inside of the casing and in that, opposite this opening, the pusher has a recess intended to take the end of a screwdriver blade.

9. The terminal block as claimed in claim 8, wherein each connection device has a conducting piece with a cross section corresponding to a U, the free ends of which have been folded obliquely and equally toward each other so as to leave between them a space corresponding to the width of the stripping and retaining slot.

10. The terminal block as claimed in claim 9, wherein the pusher has at each of its ends a substantially T-shaped profile which is narrowed at the junction between the two arms of the T, so as to be able to slide in the conducting piece on both sides and between the edges of the stripping and retaining slot by being guided inside the conducting piece.

11. The terminal block as claimed in claim 1, wherein the pusher is a piece which is symmetrical with respect to a midplane perpendicular to the stripping and retaining slots.

12. The terminal block as claimed in claim 11, wherein the stripping and retaining slots are aligned and in that the pusher is a piece which is symmetrical with respect to a midplane containing the stripping and retaining slots.

13. The terminal block as claimed in claim 1, wherein the two connection devices are connected by a linking strip on which the pusher slides.

14. The terminal block as claimed in claim 13, wherein the linking strip has a projection and wherein the pusher has two notches on its face in contact with the strip, the projection and the notches being arranged in such a way that the projection lies in a notch when the pusher lies in a position of interpenetration with respect to a connection device.

15. The terminal block as claimed in claim 1, wherein each connection device has a conducting piece with a cross section corresponding to a U, the free ends of which have been folded obliquely and equally toward each other so as to leave between them a space corresponding to the width of the stripping and retaining slot.

16. The terminal block as claimed in claim 15, wherein the pusher has at each of its ends a substantially T-shaped profile which is narrowed at the junction between the two arms of the T, so as to be able to slide in the conducting piece on both sides and between the edges of the stripping and retaining slot by being guided inside the conducting piece.

* * * * *

UNITED STATES PATENT AND TRADEMARK OFFICE

CERTIFICATE OF CORRECTION

PATENT NO. : 6,048,223

DATED : April 11, 2000

INVENTOR(S) : Bernard Bechaz, Luc Doutax and Ariel Ruiz

It is certified that error appears in the above-identified patent and that said Letters Patent is hereby corrected as shown below:

On the cover page, [75], Inventors: "Ariel Ruz" should be --Ariel Ruiz--.

On the cover page [57], Abstract: line 1, "Terminal block comprising two connection devices" should be deleted.

In Column 4, line 44, "61" should be --6'--.

Signed and Sealed this

Twentieth Day of February, 2001

*Attest:*

Nicholas P. Godici

NICHOLAS P. GODICI

*Attesting Officer*

*Acting Director of the United States Patent and Trademark Office*